US011764464B2

(12) United States Patent
Odes

(10) Patent No.: US 11,764,464 B2
(45) Date of Patent: Sep. 19, 2023

(54) SPIRAL TAPERED LOW PROFILE ULTRA WIDE BAND ANTENNA

(71) Applicant: GM GLOBAL TECHNOLOGY OPERATIONS LLC, Detroit, MI (US)

(72) Inventor: Uriel Zvi Odes, Givaat Shmuel (IL)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 58 days.

(21) Appl. No.: 17/409,627

(22) Filed: Aug. 23, 2021

(65) Prior Publication Data

US 2023/0058277 A1 Feb. 23, 2023

(51) Int. Cl.

| | |
|---|---|
| ***H01Q 1/36*** | (2006.01) |
| ***H01Q 9/28*** | (2006.01) |
| ***H01Q 1/48*** | (2006.01) |
| *H01Q 1/32* | (2006.01) |

(52) U.S. Cl.

CPC ..... *H01Q 1/36* (2013.01); *H01Q 1/48* (2013.01); *H01Q 9/285* (2013.01); *H01Q 1/3233* (2013.01)

(58) Field of Classification Search

CPC ..... H01Q 9/28; H01Q 13/04; H01Q 5/25

See application file for complete search history.

(56) References Cited

U.S. PATENT DOCUMENTS

| | | | | |
|---|---|---|---|---|
| 3,778,839 | A * | 12/1973 | Kovar | H01Q 11/083 343/895 |
| 3,942,180 | A * | 3/1976 | Rannou | H01Q 9/28 343/773 |
| 4,851,859 | A * | 7/1989 | Rappaport | H01Q 9/28 343/773 |
| 6,288,686 | B1 * | 9/2001 | Josypenko | H01Q 1/36 343/895 |
| 7,889,151 | B1 * | 2/2011 | Brock | H01Q 9/27 343/895 |
| 9,099,777 | B1 * | 8/2015 | Manry, Jr. | H01Q 1/38 |
| 10,411,357 | B1 * | 9/2019 | Ashraf | H01Q 9/40 |
| 2012/0169554 | A1 * | 7/2012 | Behdad | H01Q 9/40 343/742 |
| 2015/0280317 | A1 * | 10/2015 | Morin | H01Q 9/28 343/795 |
| 2015/0380826 | A1 * | 12/2015 | Yang | H01Q 5/25 343/846 |

(Continued)

FOREIGN PATENT DOCUMENTS

| | | | | |
|---|---|---|---|---|
| CN | 204088560 U | * | 1/2015 | H01Q 1/36 |
| CN | 104701622 A | * | 6/2015 | H01Q 1/50 |

(Continued)

OTHER PUBLICATIONS

U.S. Appl. No. 17/409,543, filed Aug. 23, 2021, Odes.
U.S. Appl. No. 17/409,586, filed Aug. 23, 2021, Odes.
U.S. Appl. No. 17/409,646, filed Aug. 23, 2021, Odes.

*Primary Examiner* — Ricardo I Magallanes

(57) ABSTRACT

An ultra wide band antenna includes a ground plane and an antenna body including a planar portion arranged above and parallel to the ground plane. A tapered spiral portion includes a T spiral tapered legs that have a spiral shape and that horizontally taper in a direction towards the ground plane, where T is an integer greater than one. L supporting legs connecting an outer edge of the planar portion to the ground plane, where L is an integer greater than one.

17 Claims, 4 Drawing Sheets

(56) References Cited

U.S. PATENT DOCUMENTS

| | | | | |
|---|---|---|---|---|
| 2016/0233590 | A1* | 8/2016 | Ng | H01Q 21/205 |
| 2017/0025766 | A1* | 1/2017 | Su | H01Q 1/36 |
| 2017/0256849 | A1* | 9/2017 | Cohen | H01Q 17/008 |
| 2018/0045822 | A1* | 2/2018 | Wötzel | H01Q 9/28 |
| 2018/0090834 | A1* | 3/2018 | Ng | H01Q 21/0006 |
| 2018/0219282 | A1* | 8/2018 | Hefele | H01Q 1/42 |
| 2018/0323515 | A1* | 11/2018 | Tang | H01Q 19/10 |
| 2018/0337461 | A1* | 11/2018 | Kildal | H01Q 9/26 |
| 2019/0190136 | A1* | 6/2019 | Sone | H01Q 9/04 |
| 2020/0028248 | A1* | 1/2020 | Kerselaers | H01Q 1/3275 |
| 2020/0036075 | A1* | 1/2020 | Ding | H01Q 1/007 |
| 2021/0083373 | A1* | 3/2021 | Gomez | H01Q 13/04 |
| 2022/0094065 | A1* | 3/2022 | Milyakh | H01Q 21/26 |
| 2022/0149524 | A1* | 5/2022 | Cheng | H01Q 1/50 |

FOREIGN PATENT DOCUMENTS

| | | | | |
|---|---|---|---|---|
| CN | 210668675 | U * | 6/2020 | H01Q 1/36 |
| KR | 101888399 | B1 * | 8/2018 | H01Q 9/045 |

* cited by examiner

SPIRAL TAPERED LOW PROFILE ULTRA WIDE BAND ANTENNA

CROSS-REFERENCE TO RELATED APPLICATIONS

This application is related to U.S. Patent Application Ser. No. 17/409,543 filed on Aug. 23, 2021 and entitled "SIMPLE ULTRA WIDE BAND VERY LOW PROFILE ANTENNA;" United States Patent Application No. 17/409,586 filed on Aug. 23, 2021 and entitled "EXTREMELY LOW PROFILE ULTRA WIDE BAND ANTENNA;" and United States Patent Application No. 17/409,646 filed on Aug. 23, 2021 and entitled "SIMPLE ULTRA WIDE BAND VERY LOW PROFILE ANTENNA ARRANGED ABOVE SLOPED SURFACE." The entire disclosure of the applications referenced above is incorporated herein by reference.

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

The present disclosure relates to antennas and more particularly to ultra wide band antennas.

Vehicles use telematics systems to support wireless telecommunications and information processing. Examples include cellular communications, global positioning system (GPS) navigation, integrated hands-free cell phones, wireless safety communication, vehicle to vehicle (V2V) communication, vehicle to infrastructure (V2I) communication, autonomous driving systems, etc.

The telematics systems transmit and receive data as the vehicle is driven on the road. To facilitate wireless connectivity, the vehicles include one or more antennas that are connected to transmitters and/or receivers of the telematics systems. Examples of antennas that are currently used include mast antennas and shark fin antennas. Various subsystems in the telematics systems transmit and receive on multiple different frequency bands. Therefore, ultra wide band (UWB) antennas are a good candidate for cellular antennas.

Manufacturers attempt to create cost-effective, fuel-efficient vehicles with attractive styling. Currently-used antenna designs are typically not desirable from a styling viewpoint. For example, the shark fin antenna may be arranged on the roof of the vehicle above a middle of the rear windshield or on the rear deck lid. As can be appreciated, placing the shark fin antenna in those locations detracts from the external design of the vehicle. These types of antennas typically have a height that is approximately ¼ of a wavelength at a lowest desired operating frequency.

SUMMARY

An ultra wide band antenna includes a ground plane and an antenna body including a planar portion arranged above and parallel to the ground plane. A tapered spiral portion includes a T spiral tapered legs that have a spiral shape and that horizontally taper in a direction towards the ground plane, where T is an integer greater than one. L supporting legs connecting an outer edge of the planar portion to the ground plane, where L is an integer greater than one.

In other features, the planar portion includes a central opening and the tapered spiral portion is spaced from the planar portion and centered relative to the central opening. The T spiral tapered legs of the tapered spiral portion are located below and connected to the planar portion outside of the central opening. A horizontal length of the T spiral tapered legs of the tapered spiral portion monotonically decreases in a direction towards the ground plane.

In other features, the planar portion has an outer edge having a shape selected from a group consisting of circular, rectangular and elliptical. An antenna feed is connected to a lower edge of the tapered spiral portion. A height of the antenna body is approximately 1/19 of a wavelength corresponding to a lowest desired operating frequency and a width of the planar portion is equal to 2 to 10 times the height of the antenna body. The planar portion includes a central opening and further comprising an annular portion that is arranged in the central opening and is coplanar with the planar portion.

In other features, an upper edge of the tapered spiral portion is connected to the annular portion and wherein the T spiral tapered legs of the spiral tapered portion are located radially inside of the central opening. A supporting structure is made of a non-conducting material and configured to support at least one of the planar portion, the spiral tapered portion, and the annular portion.

An ultra wide band antenna includes a first antenna body including a first planar portion, a first tapered spiral portion including a first T spiral tapered legs that have a spiral shape and that horizontally taper, where T is an integer greater than one, and first L supporting legs, where L is an integer greater than one. A second antenna body includes a second planar portion, a second tapered spiral portion including a second T spiral tapered legs that have a spiral shape and that horizontally taper, where T is an integer greater than one, and second L supporting legs, where L is an integer greater than one. The second antenna body is mirrored relative to the first antenna body and the first L supporting legs are connected to the second L supporting legs.

In other features, the first planar portion includes a first central opening and wherein the first tapered spiral portion is centered relative to the first central opening. The first T spiral tapered legs of the first tapered spiral portion are located below and connected to the first planar portion outside of the first central opening. A horizontal length of the first T spiral tapered legs of the first tapered spiral portion monotonically decreases. The first planar portion has an outer edge having a shape selected from a group consisting of circular, rectangular and elliptical. An antenna feed is connected to lower edges of the first tapered spiral portion and the second tapered spiral portion.

In other features, a height of the first antenna body is approximately 1/19 of a wavelength corresponding to a lowest desired operating frequency and a width of planar portion is equal to 2 to 10 times the height of the first antenna body. The first planar portion includes a first central opening and further comprising a first annular portion that is arranged in the first central opening and is coplanar with the first planar portion. An upper edge of the first tapered spiral portion is connected to the first annular portion and wherein the first T spiral tapered legs of the first spiral tapered portion are located radially inside of the first central opening. A first supporting structure made of a non-conducting material and configured to support at least one of the first planar portion, the first spiral tapered portion, and the first annular portion.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

An ultra wide band (UWB) antenna according to the present disclosure includes a planar portion, a spiral tapered portion arranged between the planar portion and a ground plane, and legs connecting edges of the planar portion to the ground plane. The UWB antenna has a very low profile that allows the UWB antenna to be arranged in less noticeable internal or external vehicle locations.

In some examples, the UWB antenna according to the present disclosure can have a height that is approximately 1/19 of a wavelength of a lowest desired operating frequency of the antenna. The very low profile allows the UWB antenna to be less noticeable when used as a cellular antenna on a roof or other location of a vehicle. For example, the UWB antenna can be concealed below a non-conducting cover in a cavity formed in a roof of the vehicle and above a grounded conducting plane (which can be the same as or different than the ground plane of the antenna).

Figure 1:
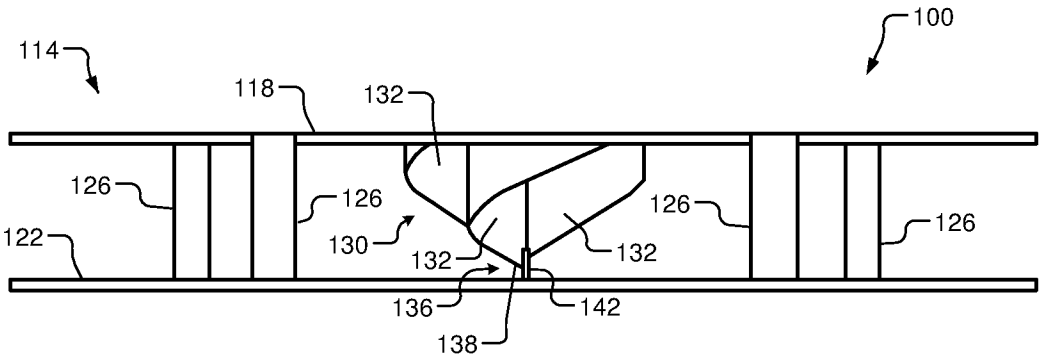
FIG. 1 is a side view of an example of an ultra wide band (UWB) antenna that includes a spiral tapered portion and that is arranged above a ground plane according to the present disclosure.
Figure 2:
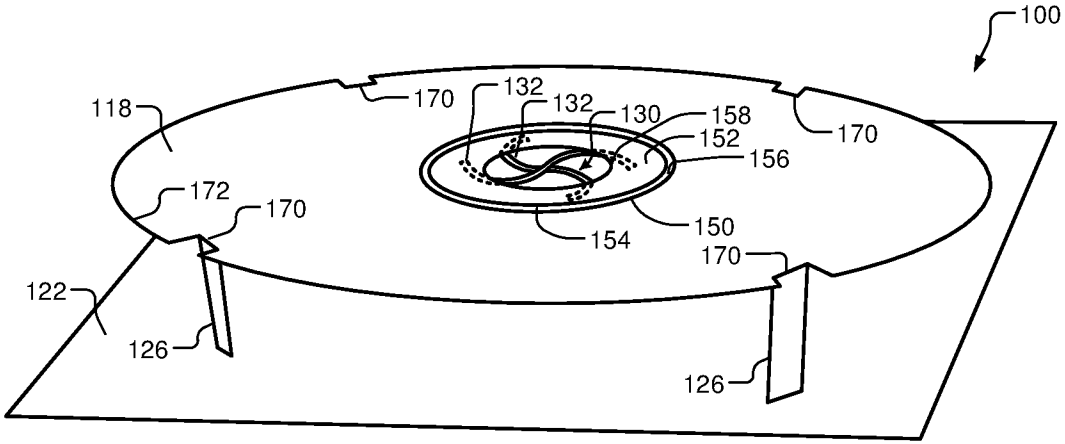
FIG. 2 is a perspective view of the UWB antenna of FIG. 1.

Referring now to FIGS. 1 and 2, an UWB antenna 100 is shown. In FIG. 1, the UWB antenna 100 includes an antenna body 114 with a planar portion 118. The planar portion 118 is arranged in a plane that is generally parallel to and above a ground plane 122. In some examples, the planar portion 118 has a generally round or elliptical in a plan view.

A tapered spiral portion 130 including T spiral tapered legs 132 (where T is an integer greater than one) is located between the planar portion 118 and the ground plane 122. The T spiral tapered legs 132 horizontally taper from a longer horizontal width to a shorter horizontal width as a distance from the planar portion 118 to the ground plane 122 decreases. The T spiral tapered legs 132 are spiral in that the legs have a spiral shape when viewed from the top. The spiral shape allows each of the legs to have a longer length in a given area. While T=4 of the T spiral tapered legs 132 are shown, two or more can be used. In some examples, each of the T spiral tapered legs 132 spiral about 360/T degrees in a horizontal plane, although higher or lower spiral angles can be used.

Outer edges of the planar portion 118 are supported on L supporting legs 126 (where L is an integer greater than one) extending between the planar portion 118 and the ground plane 122. The L supporting legs 126 extend from an outer edge of the planar portion 118 and connect to the ground plane 122.

A gap 136 is defined between a lower edge 138 of the tapered spiral portion 130 and the ground plane 122. In some examples, an antenna feed 142 extends through an opening (not shown) formed in the ground plane 122 and is connected to the antenna body 114 at the lower edge 138 of the tapered spiral portion 130. For example only, the antenna feed 142 can include an inner conductor of a coaxial cable. A woven copper shield (not shown) of the coaxial cable can be connected to the ground plane 122. While a specific type of antenna feed and feed location is shown for illustration purposes, the antenna body 114 can be fed using other antenna feed arrangements. For example, the inner conductor of the antenna feed may be arranged parallel to the ground plane 122 rather than passing through the ground plane 122.

In FIG. 2, the planar portion 118 is shown to include a central opening 150 and a top annular portion 152. A gap 156 is formed between an outer edge 154 of the top annular portion 152 and the central opening 150. The top annular portion 152 includes an inner opening 158. In some examples, a radially outer edge 172 of the planar portion 118 includes notches 170 extending inwardly and the L supporting legs 126 extend from inner edges of the notches 170.

Figure 7:
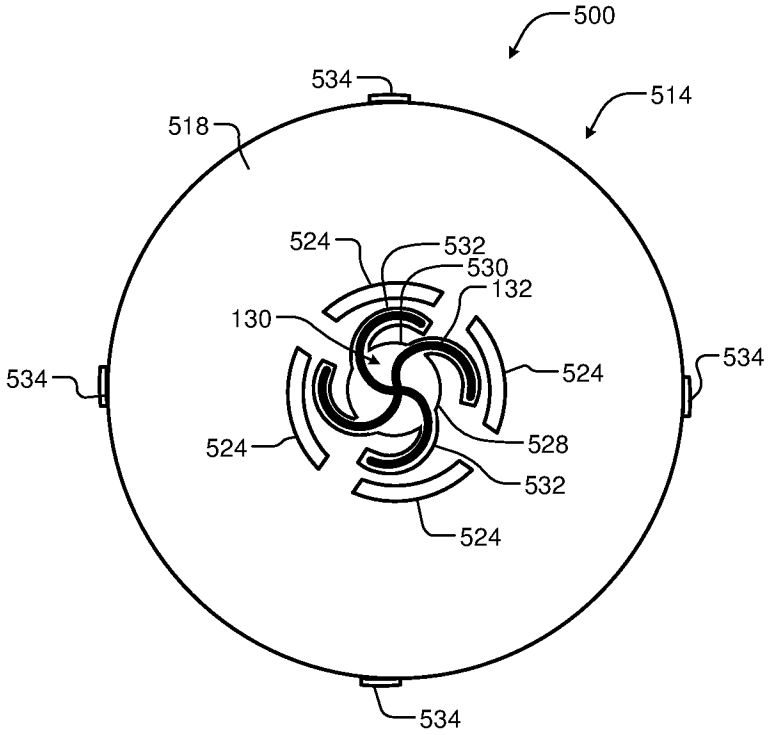
FIG. 7 is a plan view of an example of a supporting structure for an UWB antenna of FIG. 1 according to the present disclosure.

The antenna body 114 can be made entirely of conducting material such as metal. Alternately, one or more portions of the antenna body 114 can include a supporting surface that is made of a non-conducting material and a layer made of a conducting material attached to the non-conducting material. An example of a supporting structure is shown in FIG. 7, although other supporting structures can be used.

The L supporting legs 126 connect to the outer edge of the planar portion 118. While the T spiral tapered legs 132 of the tapered spiral portion 130 are connected to the top annular portion 152, they are spaced from the planar portion 118 in the central opening 150 (in other words, they are capacitively coupled to the planar portion 118). In other examples, the T spiral tapered legs 132 of the tapered spiral portion 130 are connected to the planar portion 118.

Without committing to any theory, the UWB antenna 100 operates like a monocone antenna with the planar portion acting as a capacitive top arranged at an opening of the monocone antenna and the L supporting legs acting as inductors.

Most antenna designs require the height of the UWB antenna to be approximately ¼ of the wavelength corresponding to the lowest desired operating frequency of the UWB antenna 100. The UWB antenna 100 according to the present disclosure can be designed with a very low vertical height that is approximately 1/19th of the wavelength corresponding to the lowest desired operating frequency. As used herein, approximately 1/19th of the wavelength means 4% to 6% of the wavelength corresponding to the lowest desired operating frequency of the antenna. The UWB antenna has an approximate bandwidth ratio of $F_{high}/F_{low}$=1:10, with $F_{high}$ being the highest frequency that the UWB antenna is matched to and $F_{low}$ being the lowest frequency the UWB antenna is matched to.

In some examples, the planar portion 118 can have various shapes such as circular, planar or elliptical and the width or diameter of the planar portion is 2 to 10 times the height of the antenna body 114. The ground plane 122 is generally larger than the antenna body 114. In some examples, the ground plane 122 is larger than the antenna body 114 by a predetermined distance and symmetric relative to sides of the antenna body 114. In other examples, the ground plane 122 is asymmetric relative to the sides of the antenna body 114.

Figure 3:
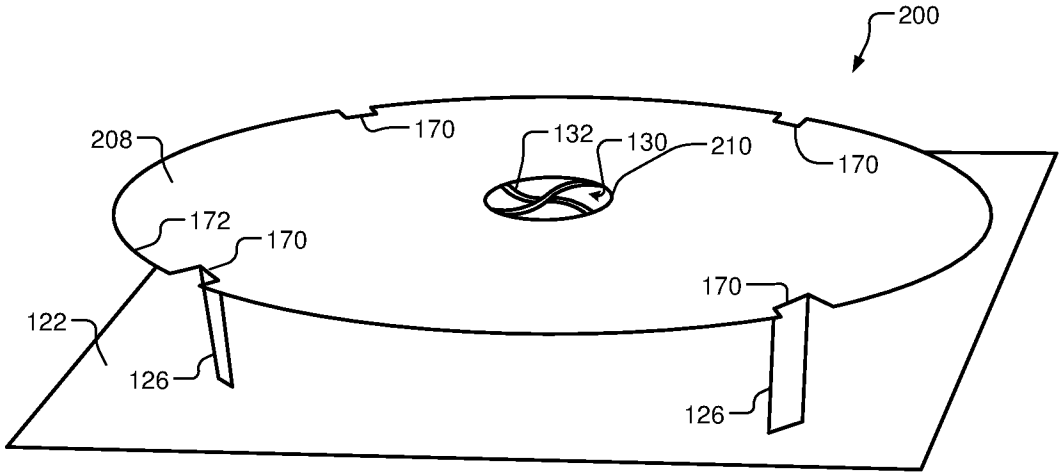
FIG. 3 is a perspective view of another example of an ultra wide band (UWB) antenna that includes a spiral tapered portion and that is arranged above a ground plane according to the present disclosure.
Figure 4:
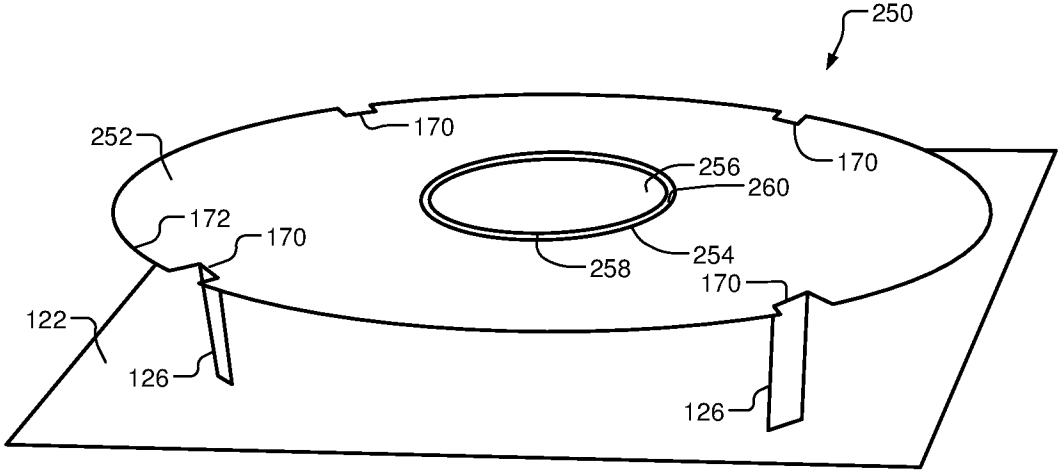
FIG. 4 is a perspective view of another example of an ultra wide band (UWB) antenna that includes a spiral tapered portion and that is arranged above a ground plane according to the present disclosure.
Figure 5:
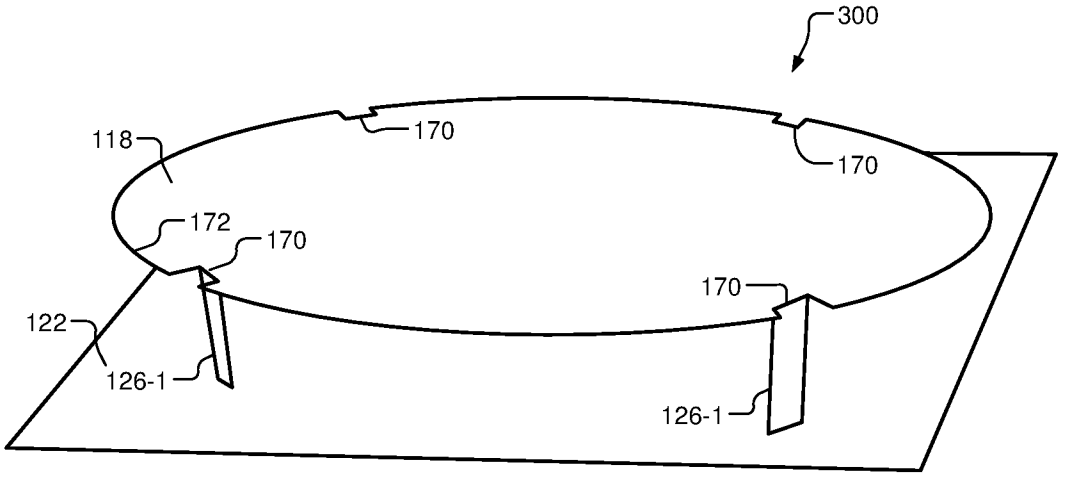
FIG. 5 is a perspective view of another example of an ultra wide band (UWB) antenna that includes a spiral tapered portion and that is arranged above a ground plane according to the present disclosure.

Referring now to FIGS. 3-5, the number, size and location of the openings in the planar portion can be varied or one or all of the openings can be omitted. In FIG. 3, an UWB antenna 200 includes a central opening 210 in a planar portion 208. Radially inner portions of the T spiral tapered legs 132 of the tapered spiral portion 130 are not covered by the planar portion 118 as shown. Radially outer portions of the T spiral tapered legs 132 are covered by and connected to the planar portion 118 as shown.

In FIG. 4, an UWB antenna 250 includes a planar portion 252 is annular including a central opening 254. A center planar portion 256 is coplanar with the planar portion 252 and includes a radially outer edge 258 that defines an annular opening 260 relative to the central opening 254. The center planar portion 256 can be arranged in contact with upper edges of the T spiral tapered legs (not shown). The slotted opening 260 can be arranged radially outside of the T spiral tapered legs. Alternately, the slotted opening 260 can be arranged to overlap portions of the T tapered spiral legs as long as the T tapered spiral legs do not short the gap. In other words, as long as the gap doesn't have a bypass (the T tapered spiral legs) that forms an electrical continuity.

In FIG. 5, an UWB antenna 300 includes a planar portion 318 with no openings.

Figure 6:
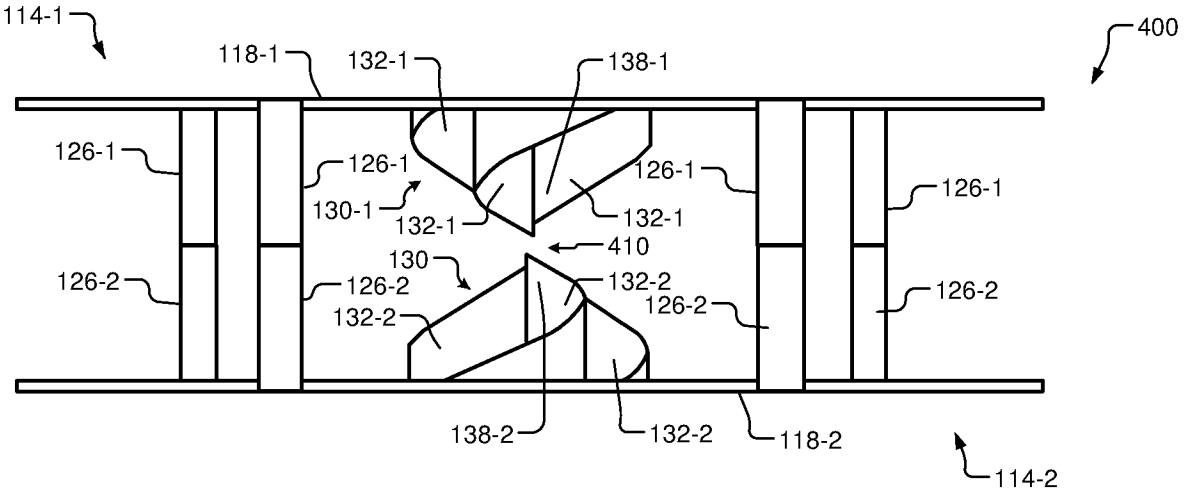
FIG. 6 is a side view of an example of an UWB antenna including a first antenna body and a second antenna body that is mirrored and connected to the first antenna body according to the present disclosure.

In the UWB antennas shown in FIGS. 1 to 5, the UWB antenna is arranged above the ground plane 122. In this design, the ground plane 122 acts as a mirror. A similar effect can be achieved by adding a second antenna body that is mirrored relative to the removed ground plane and connected to the first antenna body as shown in FIG. 6. The mirrored effect is similar to the mirroring of a monopole antenna above a ground plane to obtain a dipole antenna in free space without a ground plane.

In FIG. 6, another example of an UWB antenna 400 is shown. The UWB antenna 400 includes first and second antenna bodies 114-1 and 114-2. The second antenna body 114-2 is mirrored and connected to edges 138-1 and 138-2 of the first antenna body 114-1. The first and second antenna bodies 114-1 and 114-2 are similar to the antenna body 114 described in FIG. 1. Similar reference numbers are used for components associated with the first antenna body 114-1 ("-1" appended) and the second antenna body 114-2 ("-2" appended). Ends of the legs 126-1 of the first antenna body 114-1 are connected to ends of the legs 126-2 of the second antenna body 114-2. Antenna feed locations 410 are connected to the tapered spiral portions 130-1 and 130-2 of the first and second antenna bodies 114-1 and 114-2, respectively.

Referring now to FIG. 7, an example of an antenna supporting structure 500 that can be used to support portions of the antenna body of FIG. 1 is shown. In some examples, the antenna supporting structure 500 comprises a non-conducting body 514 including a non-conducting planar portion 518 arranged below the planar portion of the antenna body and non-conducting legs 534. In some examples, the non-conducting planar portion 518 includes S slots 524 (where S is an integer greater than one) that are arranged in a pattern. In some examples, S=4 although additional or fewer slots can be used. In some examples, the S slots 524 are arcuate and the pattern is circular, although other slot shapes and patterns can be used.

An inner opening 528 in the non-conducting planar portion 518 is located inside of the S slots 524 and includes a center opening 530 and spiral openings 532 extending outwardly from the center opening 530. In some examples, portions of the T spiral tapered legs 132 of the tapered spiral portion 130 are arranged in the spiral openings 532 and the center opening 530. In this example, the non-conducting legs 534 extend from an outer edge of the non-conducting planar portion 518 (rather than from notches shown above). Components of the antenna body are arranged on top of and connected to the antenna supporting structure 500, which provides support.

The length, width and height of the UWB antennas described herein can be adjusted to achieve different design criteria such as frequency, bandwidth and/or radiation profile of the UWB antennas.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

What is claimed is:

1. An ultra wide band antenna, comprising:

a ground plane; and an antenna body including:

a planar portion arranged above and parallel to the ground plane;

a tapered spiral portion including a T spiral tapered legs that have a spiral shape and that horizontally taper in a direction towards the ground plane, where Tis an integer greater than one, wherein each of the T spiral tapered legs extends radially outward from a center of the planar portion in a horizontal plane; and L supporting legs connecting an outer edge of the planar portion to the ground plane, where L is an integer greater than one, wherein the planar portion includes a central opening, and the ultra wide band antenna further comprises an annular portion that is arranged in the central opening, spaced from the planar portion and coplanar with the planar portion, and wherein an upper edge of the tapered spiral portion is connected to the annular portion and wherein the T spiral tapered legs of the tapered spiral portion are located radially inside of the central opening.

2. The ultra wide band antenna of claim 1, wherein the tapered spiral portion is spaced from the planar portion and centered relative to the central opening.

3. The ultra wide band antenna of claim 1, wherein the T spiral tapered legs of the tapered spiral portion are located below and connected to the planar portion outside of the central opening.

4. The ultra wide band antenna of claim 1, wherein a horizontal length of the T spiral tapered legs of the tapered spiral portion monotonically decreases in a direction towards the ground plane.

5. The ultra wide band antenna of claim 1, wherein the planar portion has an outer edge having a shape selected from a group consisting of circular, rectangular and elliptical.

6. The ultra wide band antenna of claim 1, wherein an antenna feed is connected to a lower edge of the tapered spiral portion.

7. The ultra wide band antenna of claim 1, wherein a height of the antenna body is approximately 1/19 of a wavelength corresponding to a lowest desired operating frequency and a width of the planar portion is equal to 2 to 10 times the height of the antenna body.

8. The ultra wide band antenna of claim 1, further comprising a supporting structure made of a non-conducting material and configured to support at least one of the planar portion, the spiral tapered portion, and the annular portion.

9. An ultra wide band antenna, comprising:

a first antenna body including:

a first planar portion;

a first tapered spiral portion including a first T spiral tapered legs that have a spiral shape and that horizontally taper, where Tis an integer greater than one; and first L supporting legs, where Lis an integer greater than one; and a second antenna body including:

a second planar portion;

a second tapered spiral portion including a second T spiral tapered legs that have a spiral shape and that horizontally taper, where T is an integer greater than one; and second L supporting legs, where L is an integer greater than one, wherein the second antenna body is mirrored relative to the first antenna body and the first L supporting legs are connected to the second L supporting legs, and wherein each of the T spiral tapered legs spirals ninety degrees in a horizontal plane, wherein the first planar portion includes a central opening, and the ultra wide band antenna further comprises an annular portion that is arranged in the central opening, spaced from the first planar portion and coplanar with the first planar portion, and wherein an upper edge of the first tapered spiral portion is connected to the annular portion and wherein the first T spiral tapered legs of the first tapered spiral portion are located radially inside of the central opening.

10. The ultra wide band antenna of claim 9, wherein the first tapered spiral portion is spaced from the first planar portion and centered relative to the central opening.

11. The ultra wide band antenna of claim 9, wherein the first T spiral tapered legs of the first tapered spiral portion are located below and connected to the first planar portion outside of the central opening of the first planar portion.

12. The ultra wide band antenna of claim 9, wherein a horizontal length of the first T spiral tapered legs of the first tapered spiral portion monotonically decreases.

13. The ultra wide band antenna of claim 9, wherein the first planar portion has an outer edge having a shape selected from a group consisting of circular, rectangular and elliptical.

14. The ultra wide band antenna of claim 9, wherein an antenna feed is connected to lower edges of the first tapered spiral portion and the second tapered spiral portion.

15. The ultra wide band antenna of claim 10, wherein a height of the first antenna body is approximately 1/19 of a wavelength corresponding to a lowest desired operating frequency and a width of planar portion is equal to 2 to 10 times the height of the first antenna body.

16. The ultra wide band antenna of claim 9, further comprising a first supporting structure made of a non-conducting material and configured to support at least one of the first planar portion, the first spiral tapered portion, and the annular portion.

17. An ultra wide band antenna, comprising:

a ground plane; and an antenna body including:

a planar portion arranged above and parallel to the ground plane, the planar portion including a central opening;

a tapered spiral portion including a T spiral tapered legs that have a spiral shape and that horizontally taper in a direction towards the ground plane, where T is an integer greater than one;

L supporting legs connecting an outer edge of the planar portion to the ground plane, where L is an integer greater than one; and an annular portion that is arranged in the central opening, spaced from the planar portion and coplanar with the planar portion, wherein an upper edge of the tapered spiral portion is connected to the annular portion and wherein the T spiral tapered legs of the spiral tapered portion are located radially inside of a central opening.

* * * * *